US006380824B1

(12) United States Patent
Nishijima et al.

(10) Patent No.: US 6,380,824 B1
(45) Date of Patent: Apr. 30, 2002

(54) DIELECTRIC FILTER, COMPOSITE DIELECTRIC FILTER, DUPLEXER, AND COMMUNICATION APPARATUS

(75) Inventors: Shohachi Nishijima, Komatsu; Motoharu Hiroshima; Hideyuki Kato, both of Ishikawa-ken, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/394,845

(22) Filed: Sep. 13, 1999

(30) Foreign Application Priority Data

Sep. 11, 1998 (JP) ..... 10-258623
Jul. 15, 1999 (JP) ..... 11-201505

(51) Int. Cl.[7] ..... H01P 1/213; H01P 1/202

(52) U.S. Cl. ..... 333/134; 333/206; 333/222; 333/202

(58) Field of Search ..... 333/134, 206, 333/222, 202

(56) References Cited

U.S. PATENT DOCUMENTS 5,831,495 A * 11/1998 Hino ..... 333/202
5,905,420 A * 5/1999 Tsujiguchi et al. ..... 333/206
5,929,721 A * 7/1999 Munn et al. ..... 333/134
6,002,306 A * 12/1999 Arakawa ..... 333/134

* cited by examiner

*Primary Examiner*—Robert Pascal
*Assistant Examiner*—Stephen E. Jones
(74) *Attorney, Agent, or Firm*—Ostrolenk, Faber, Gerb & Soffen, LLP

(57) ABSTRACT

There is provided a dielectric filter comprising: a dielectric block; a plurality of resonance lines aligned substantially in parallel in the dielectric block; and a conductor line disposed in the dielectric block so as not to be parallel to the longitudinal direction of the resonance lines, the conductor line being served as a device having an inductance component which is connected to a circuit comprising the resonance lines.

16 Claims, 12 Drawing Sheets

FIG. 14A
PRIOR ART
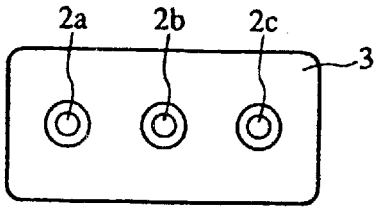
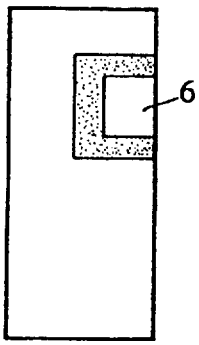
FIG. 14D
PRIOR ART
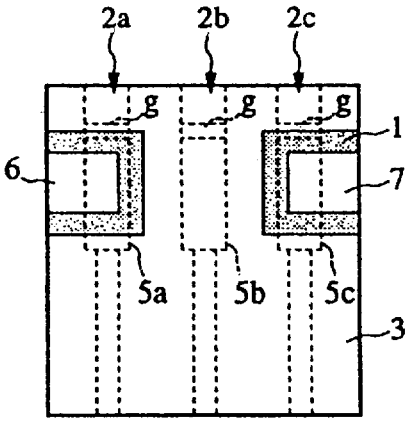
FIG. 14B
PRIOR ART
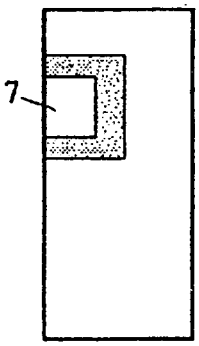
FIG. 14E
PRIOR ART
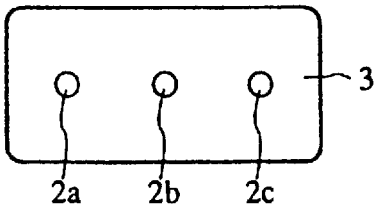
FIG. 14C
PRIOR ART

DIELECTRIC FILTER, COMPOSITE DIELECTRIC FILTER, DUPLEXER, AND COMMUNICATION APPARATUS

BACKGROUND OF THE INVENTION

1. Field of the Invention

The present invention relates to a dielectric filter, a composite dielectric filter and a duplexer used in high-frequency bands, and a communication apparatus including the same.

2. Related Art

FIGS. 14A, 14B, 14C, 14D, 14E show a structure of a prior art dielectric filter comprising a dielectric block, which is mainly used in the micro-wave band. In this figures, FIG. 14B is a front view in which the dielectric filter is vertically stood, FIG. 14A is an upper-surface view, FIG. 14C is a bottom view, FIG. 14D is a left-side view, and FIG. 14E is a right-side view. In these figures, a reference numeral 1 indicates a dielectric block. Resonance-line holes indicated by numerals 2*a*, 2*b*, and 2*c* are disposed in the dielectric block 1. And, resonance lines 5*a*, 5*b*, and 5*c* are disposed on the inner surfaces of the resonance-line holes 2*a*, 2*b*, and 2*c*. A ground electrode 3 is disposed on an outer surface of the dielectric block 1. External terminals 6 and 7 are also disposed on the outer surface of the dielectric block 1 at predetermined portion so as to be insulated from the ground electric 3. The external terminal 6 and the resonance line 5*a* make capacitive coupling, whereas the external terminal 7 and the resonance line 5*c* make capacitive coupling. This arrangement permits the dielectric filter having band-pass characteristics of three stage resonators.

In the prior art dielectric filter using such a dielectric block, when another circuit device is added to a dielectric filter having a basic structure shown in FIGS. 14A to 14E, for example, when an inductance device is disposed, the inductance device is provided by soldering a coil as an individual component to an electrode on a surface of the dielectric block, or by using an electrode pattern disposed on the surface of the dielectric block.

However, in the former structure, not only is an additional component necessary besides the dielectric block, but the higher the frequency band used, the extremely smaller the dielectric block. Thus, installation of the additional component is difficult from a viewpoint of production. In the latter structure, as the dielectric block is miniaturized, it become difficult to dispose a large inductance. Thus, when the dielectric block is further miniaturized, the formation of a conductor pattern on the surface thereof is difficult.

SUMMARY OF THE INVENTION

To overcome the above described problems, preferred embodiments of the present invention provide a dielectric filter, a composite dielectric filter, duplexer and a communication apparatus including the same, in which a desired characteristic can be easily obtained by providing a device with an inductance component in a dielectric block constituting a dielectric filter.

One preferred embodiment of the present invention provides a dielectric filter comprising: a dielectric block; a plurality of resonance lines aligned substantially in parallel in the dielectric block; and a conductor line disposed in the dielectric block so as not to be parallel to the longitudinal direction of the resonance lines, the conductor line being served as a device having an inductance component which is connected to a circuit comprising the resonance lines.

According to the above described structure and arrangement, although the conductor line disposed in non-parallel to the direction in which the resonance lines are aligned is disposed inside the dielectric block, it does not operate as a resonance line coupled to the resonance lines. On the other hand, the inductance component thereof is utilized. Since the conductor line is provided inside the dielectric block, as in the case of formation of the resonance lines, for example, a hole is formed in the dielectric block so as to easily make a minute line by electroless plating. Moreover, the conductor-line length can be set to be longer than that in the case of formation of an inductance component on a surface of the dielectric block by providing an electrode pattern and a large inductance can thereby be obtained, although the dielectric block is compact.

The above described dielectric filter may further comprise: a ground electrode disposed on a surface of the dielectric block; and an electrode disposed at an end of the conductor line and generating a capacitance component between the ground electrode and the electrode.

According to the above structure and arrangement, an LC circuit is formed of the inductance component of the conductor line and the capacitance component between the electrode provided at the conductor-line end and the ground electrode. For example, this structure permits a low pass filter, a high pass filter, or a band block filter (a trap) to be formed.

Another preferred embodiment of the present invention provides a composite dielectric filter comprising: a dielectric block; a first filter section comprising a plurality of resonance lines aligned substantially in parallel in the dielectric block; a conductor line disposed in the dielectric block so as not to be parallel to a direction in which the resonance lines are aligned in the dielectric block; a ground electrode disposed on a surface of the dielectric block; an electrode disposed at an end of the conductor line and generating a capacitance component between the ground electrode and the electrode; and a second filter section comprising an inductance component of the conductor line and the capacitance component.

According to the above structure and arrangement, for example, when the first filter section comprising the plurality of resonance lines aligned substantially in parallel is used as a band pass filter and the second filter section comprising the inductance component of the conductor line in the dielectric block and the capacitance component between the electrode at the conductor-line end and the ground electrode is used as a low pass filter, a composite dielectric filter in which the band pass filter and the low pass filter are combined can be obtained easily.

Yet another preferred embodiment of the present invention provides a composite dielectric filter comprising: a plurality of dielectric filters including the above described dielectric filter, or the above described composite dielectric filter, which are provided in a common dielectric block.

The above structure and arrangement, for example, permits a further miniaturized composite dielectric filter overall such as a diplexer, a duplexer, a multiplexer, or the like, to be obtained.

Yet another preferred embodiment of the present invention provides a duplexer having a transmission-signal input unit, a reception-signal output unit, and an antenna connection unit, in which the dielectric filter or the composite dielectric filter described above is used as a transmission filter and a reception filter.

Yet another preferred embodiment of the present invention provides a communication apparatus comprising the above described dielectric filter, the above described composite dielectric filter, or the above described duplexer disposed in a high-frequency circuit section.

The above structure and arrangement permit a compact and lightweight communication apparatus to be obtained.

Other features and advantages of the present invention will become apparent from the following description of the invention which refers to the accompanying drawings.

BRIEF DESCRIPTION OF DRAWINGS

FIGS. 14A, 14B, 14C, 14D and 14E shows a structure of a prior art dielectric filter.

DESCRIPTION OF THE PREFERRED EMBODIMENTS

Figure 1A:
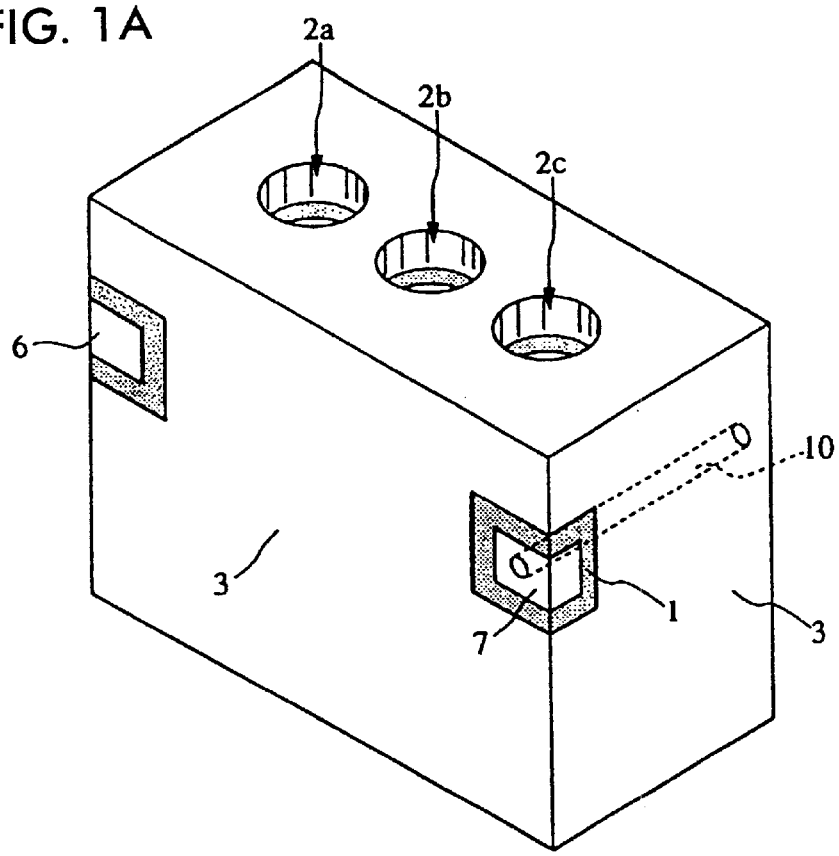
FIGS. 1A and 1B are respectively a perspective view and a sectional view of a dielectric filter according to a first preferred embodiment of the present invention.
Figure 1B:
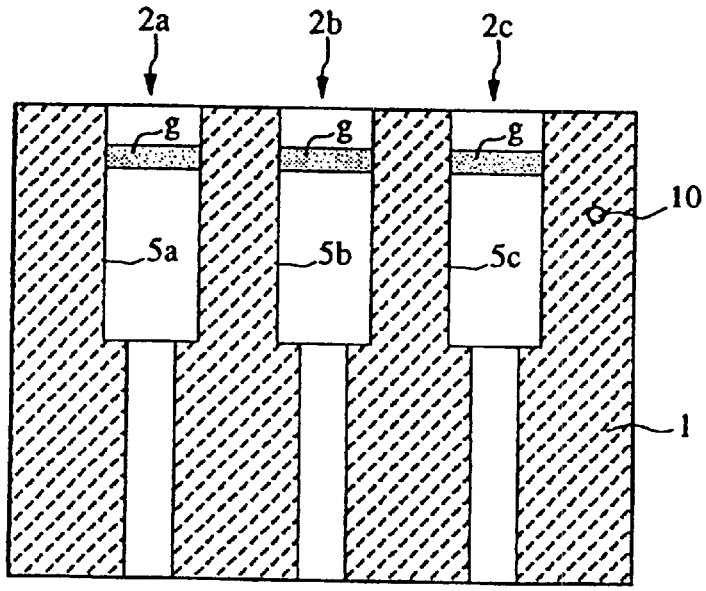

Referring to FIGS. 1A and 1B, a description will be provided of a structure of a dielectric filter according to a first preferred embodiment of the present invention.

This dielectric filter comprises a rectangular-parallelepiped dielectric block 1 with holes having predetermined shapes and electrodes. That is, numerals 2*a*, 2*b*, and 2*c* indicate resonance-line holes, on the inner surfaces of which are formed resonance lines 5*a*, 5*b*, and 5*c*, respectively. The resonance-line holes 2*a* through 2*c* are step holes whose lengths of the respective inner diameters are different between the upper-half part and the lower-half part as shown in the figures. On each of the resonance lines, a nonconductive portion indicated by the symbol g is disposed near the end of the large inner-diameter side of the step hole to use this part as an open end. On an outer surface of the dielectric block 1, terminal electrodes 6 and 7 are disposed to make capacitance between the electrodes and the resonance lines 5*a* and 5*c*, respectively, whereas a ground electrode 3 is disposed on the approximately entire surfaces (six faces) excluding these parts where the terminal electrodes are disposed.

In this arrangement, the resonance lines 5*a*, 5*b*, and 5*c* sequentially make comb-line coupling and capacitance coupling is made between the terminal electrodes 6 and 7 and the resonance lines 5*a* and 5*c*, respectively, whereby a filter circuit with band-pass characteristics, in which three stage resonators make coupling, is provided.

The dielectric block 1 includes the conductor line 10 extended perpendicularly to the longitudinal direction of the resonance lines 5*a* through 5*c* disposed on the inner surfaces of the resonance-line holes 2*a* through 2*c*. At least one end of the conductor line 10 is electrically connected to the terminal electrode 7. The resonance lines 5*a* through 5*c*, the terminal electrodes 6 and 7, and the ground electrode 3 are provided by electrodeless plating on the dielectric block 1. When the electrodeless plating is conducted, the conductor line 10 is simultaneously provided together with the electrodes of the respective parts. That is, the conductor line 10 is provided by conducting the electrodeless plating on the inner surface of a through hole for providing the conductor line 10 to be disposed at a predetermined place of the dielectric block 1.

As shown in the structure described above, an inductance device made by the conductor line 10 is disposed in the dielectric block constituting a dielectric filter.

Although the example shown in FIG. 1 has step holes as the resonance-line holes, it is also possible to use straight holes, in which the inner diameter of each hole is constant between the short-circuited end and the open end.

Figure 13A:
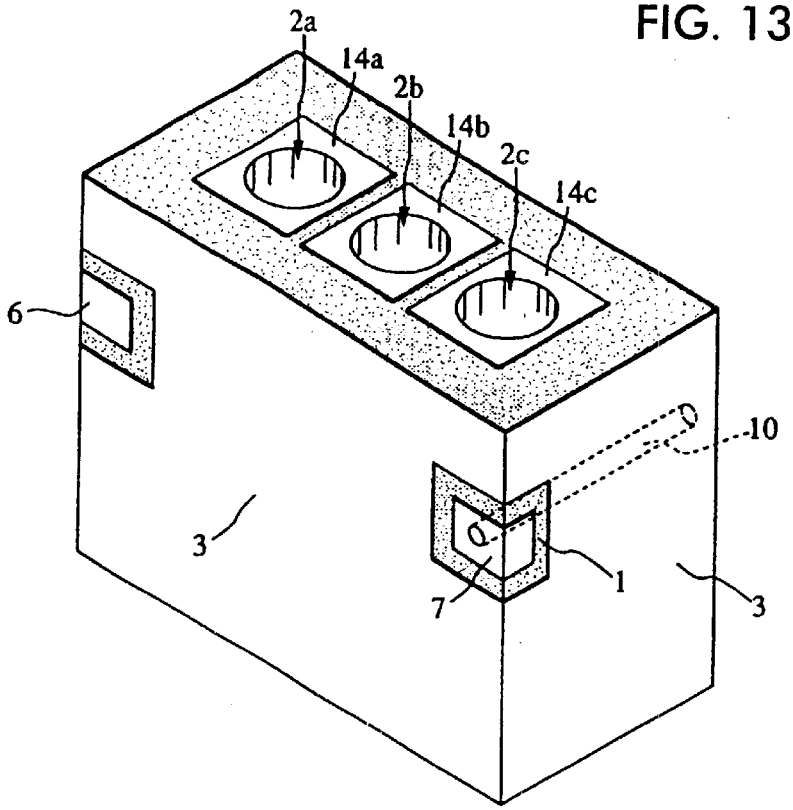
FIGS. 13A and 13B are perspective view of a dielectric filter of the present invention having alternative structures.

Furthermore, in the example shown in FIGS. 1A and 1B, the outer conductor is provided on the outer surfaces (six faces) of the dielectric block and the nonconductive portions are disposed on the inner surfaces of the resonance-line holes. However, for example, as shown in FIG. 13A, open-end terminals 14*a*, 14*b*, and 14*c* to be continued from the resonance lines may be provided on an end face of the dielectric block, which is an open end of each resonance-line hole. In this structure, the resonance-line holes may be either step holes or straight holes.

Figure 13B:
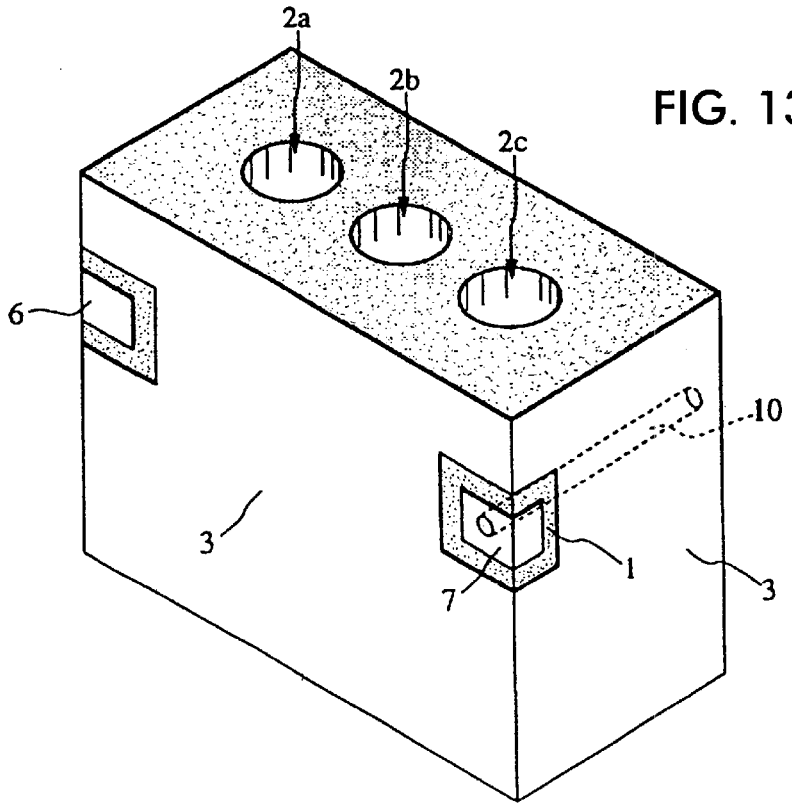

Additionally, when the resonance-line holes are step holes, as shown in FIG. 13B, an end face of the dielectric block, which is an opening of each resonance-line hole, may be the open face.

Figure 2:
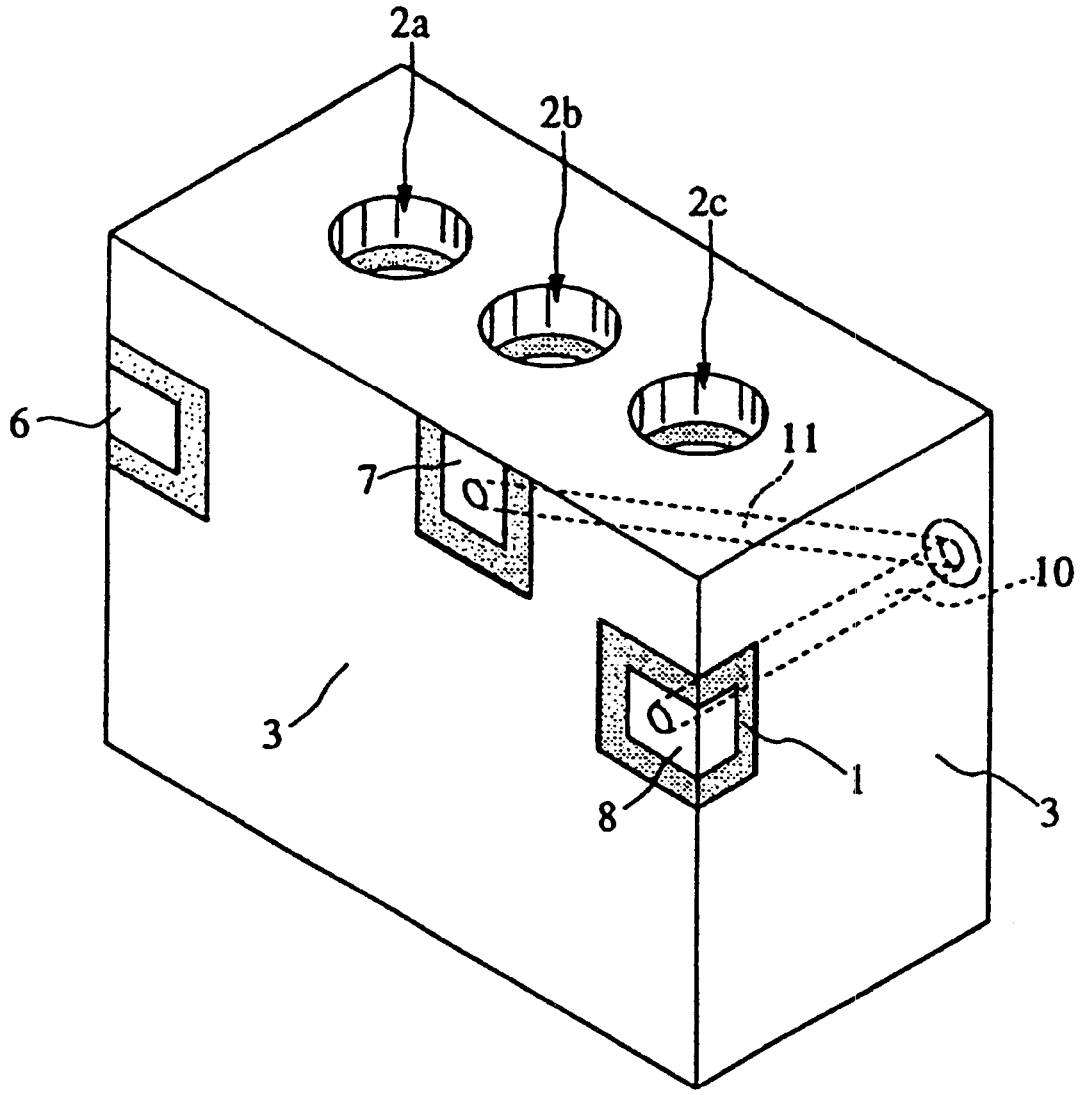
FIG. 2 is a perspective view of a dielectric filter according to a second preferred embodiment of the present invention.

A description will be given of a structure of a dielectric filter according to a second preferred embodiment referring to FIG. 2.

This dielectric filter is an embodiment in which conductor lines 10 and 11 are disposed not in parallel, but in a slanting direction with respect to the lengthwise direction of the resonance-line holes 2*a* through 2*c* in the dielectric block 1. In FIG. 2, reference numerals 6, 7, and 8 respectively indicate terminal electrodes provided on an outer surface of the dielectric block 1, and the conductor lines 11 and 10 are disposed between the terminal electrodes 7 and 8.

Since the conductor lines 10 and 11 are disposed in non-parallel to the lengthwise direction of the resonance lines, they do not operate as resonance lines coupling to the resonance lines provided in the resonance-line holes 2*a* through 2*c*. Instead, these conductor lines can be used as inductance devices. Moreover, a large amount of inductance can be generated in a limited space by arranging the conductor lines in a slanting direction with respect to the lengthwise direction of the resonance lines.

Referring to FIGS. 3A through 5, a description will be given of a structure of the dielectric filter according to a third preferred embodiment.

Figure 3A:
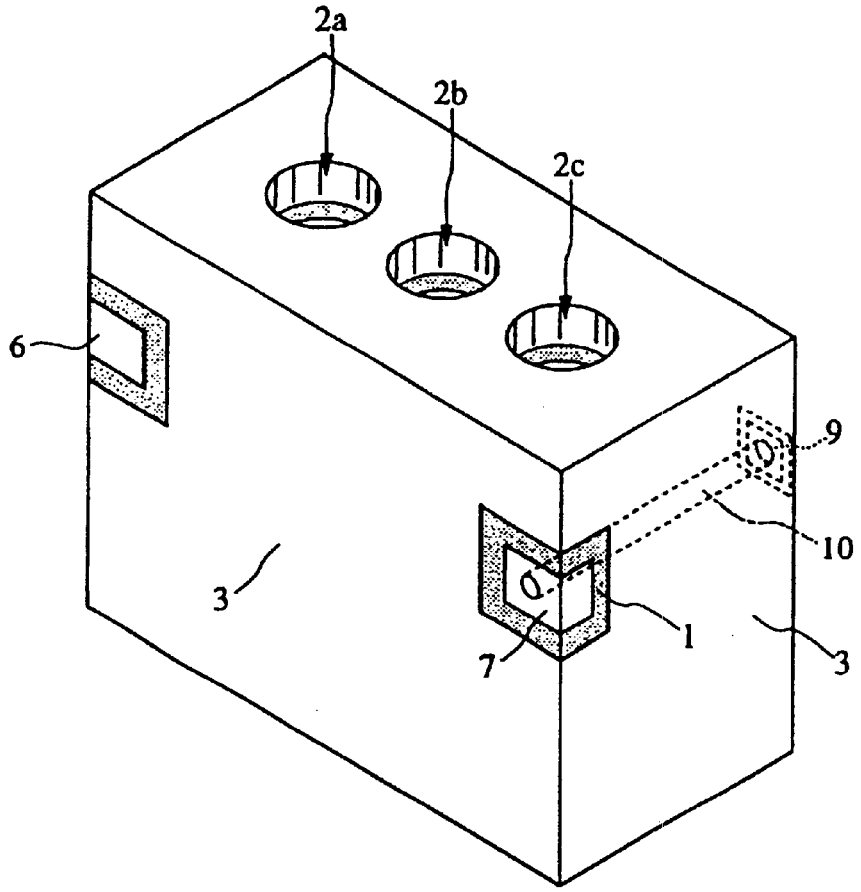
FIGS. 3A and 3B are a perspective view and a back view of a dielectric filter according to a third preferred embodiment of the present invention.
Figure 3B:
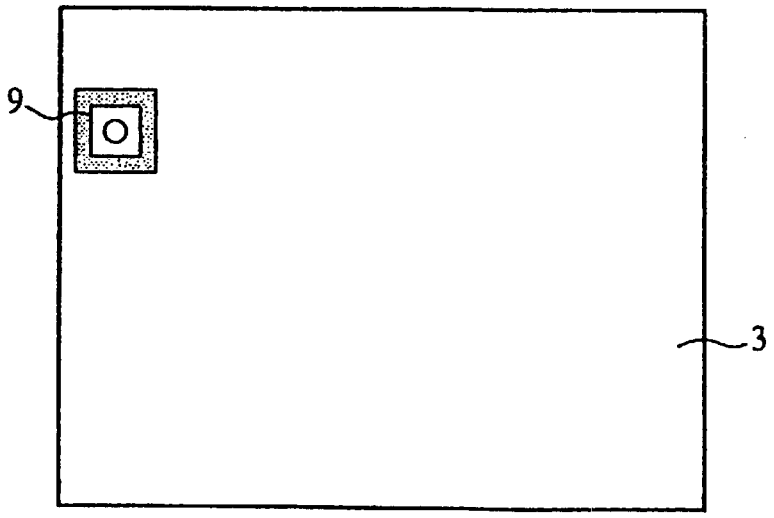

FIG. 3A is an outward perspective view, and FIG. 3B is a back view of the dielectric block in the state shown in FIG. 3A. The entire basic structure is the same as that shown in FIGS. 1A and 1B. However, one end of the conductor line 10 is electrically connected to the terminal electrode 7, and the other end of the same is electrically connected to the terminal electrode 9 which is formed as an island-like part separated from the ground electrode 3, as in the terminal electrodes 6 and 7, so as to generate capacitance between the terminal electrode and the ground electrode 3.

With the above structure, an inductance device made by the conductor line 10 is disposed in the dielectric block forming a dielectric filter.

Figure 4:
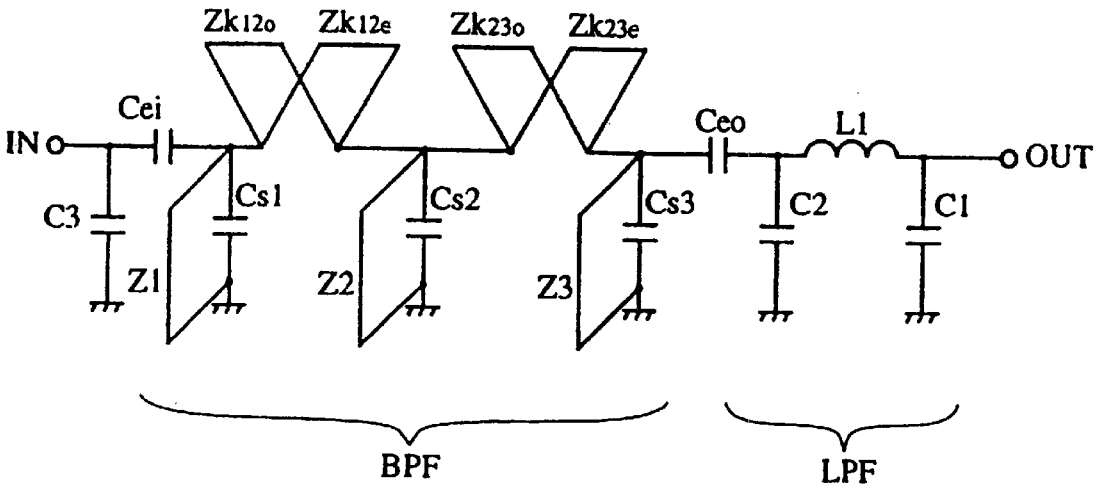
FIG. 4 is an equivalent circuit diagram of the dielectric filter shown in FIGS. 3A and 3B.

FIG. 4 is an equivalent circuit diagram of the above-described dielectric filter. In this case, reference numerals Z1, Z2, and Z3 indicate the impedance of the resonance lines disposed on the inner surfaces of the respective resonance-line holes 2*a*, 2*b*, and 2*c*. Reference numerals Cs1, Cs2, and Cs3 indicate capacitance generated at the nonconductive portions g (see FIGS. 1A and 1B) of the resonance lines. Reference numeral $Zk_{12o}$ indicates the characteristic impedance of an odd mode for making the comb-line coupling between the resonance lines on the inner surfaces of the resonance-line holes 2*a* and 2*b*, and reference numeral $Zk_{12e}$ indicates the characteristic impedance of an even mode in the same case. Reference numeral $Zk_{23o}$ indicates the characteristic impedance of an odd mode for making the comb-line coupling between the resonance lines on the inner surfaces of the resonance-line holes 2*b* and 2*c*, and $Zk_{23e}$ indicates the characteristic impedance of an even mode in the same case. Reference numeral Cei indicates the capacitance between the terminal electrode 6 and the resonance line on the inner surface of the resonance-line hole 2*a*, and reference numeral C3 indicates the capacitance between the terminal electrode 6 and the ground electrode 3. Reference numeral Ceo indicates the capacitance between the terminal electrode 9 and the resonance line on the inner surface of the resonance-line hole 2*c*, and reference numeral C2 indicates the capacitance between the terminal electrode 9 and the ground electrode 3. Reference numeral L1 indicates the inductance of the conductor line 10, and reference numeral C1 indicates the capacitance between the terminal electrode 7 and the ground electrode 3.

The parts C1, C2, and L1 shown in FIG. 4 constitute a Π-type low pass filter. In addition, the part of the three resonance lines making comb-line coupling operates as a band pass filter. Accordingly, the filter circuit is formed by connecting the band pass filter and the low pass filter.

Figure 5:
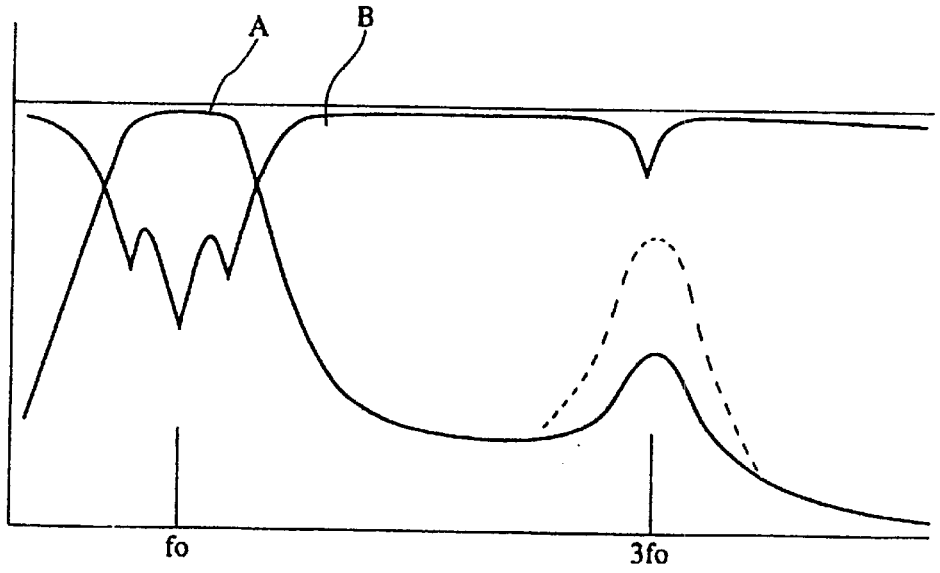
FIG. 5 is a characteristic chart of the dielectric filter shown in FIGS. 3A and 3B.

FIG. 5 shows a characteristic chart of the dielectric filter described above. A shows a transmission characteristic and B shows a reflection characteristic. The band pass filter allows signals of a specified bandwidth to pass when a center frequency is set as fo, whereas the low pass filter allows the blocking frequency to be set between fo and 3fo to lower the frequency band near 3fo. A broken line shown in the figure indicates a characteristic obtained when the low pass filter is not disposed. As described above, a characteristic in which a spurious response of the third harmonic is suppressed can be obtained.

Referring to FIGS. 6A through 8, a description will be given of a structure of a diplexer according to a fourth preferred embodiment.

Figure 6A:
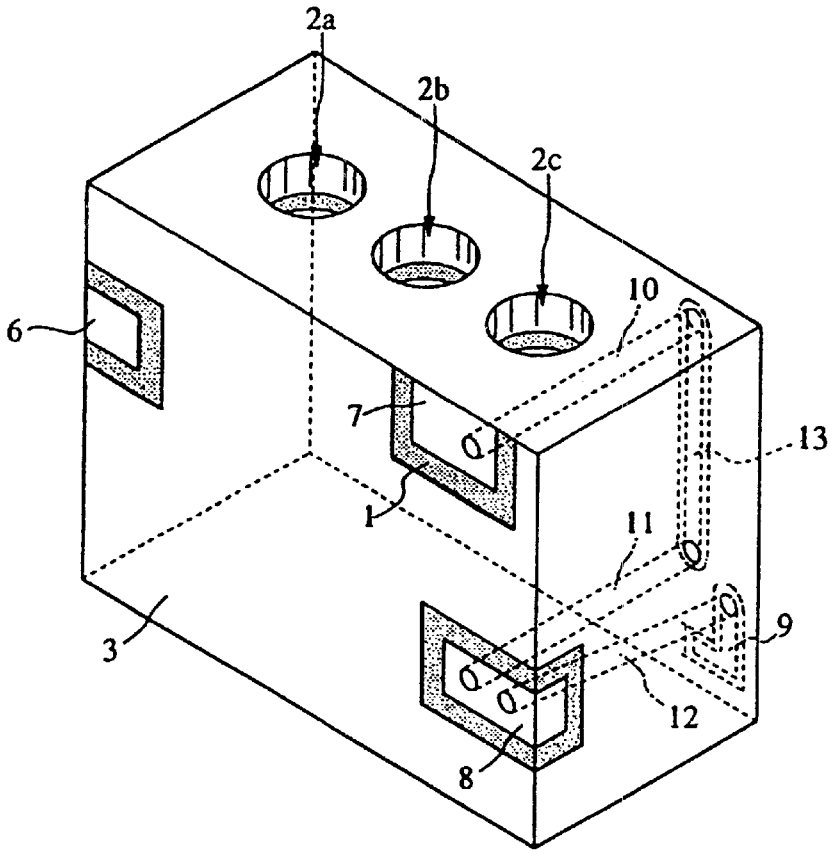
FIGS. 6A and 6B are respectively a perspective view and a back view of a diplexer according to a fourth preferred embodiment of the present invention.
Figure 6B:
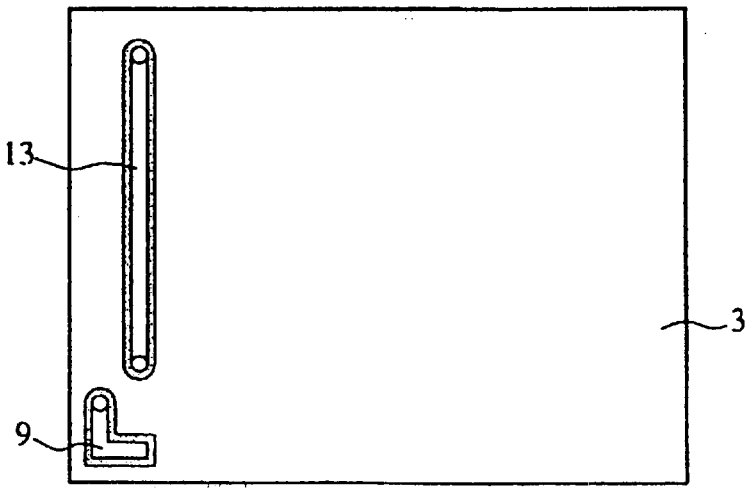

FIG. 6A is an outward perspective view, and FIG. 6B is a back view of the dielectric block shown in FIG. 6A. The resonance-line holes 2*a*, 2*b*, and 2*c* are formed in the dielectric block 1, and on the inner surfaces of the holes are disposed resonance lines and nonconductive portions g. This arrangement is the same as that shown in the first through third preferred embodiments. In this diplexer, terminal electrodes 6, 7, 8, and 9, and a conductor-line electrode 13 are respectively formed at specified places on an outer surface of the dielectric block 1. Inside the dielectric block 1, the conductor line 10 is disposed between the terminal electrode 7 and one end of a conductor-line electrode 13; the conductor line 11 is disposed between the terminal electrode 8 and the other end of the conductor-line electrode 13; and a conductor line 12 is disposed between the terminal electrodes 8 and 9. In this case, the conductor-line electrode 13 acts as an intermediary between the conductor lines 10 and 11, in which the conductor-line electrode 13 itself is allowed to have an inductance component.

Figure 7:
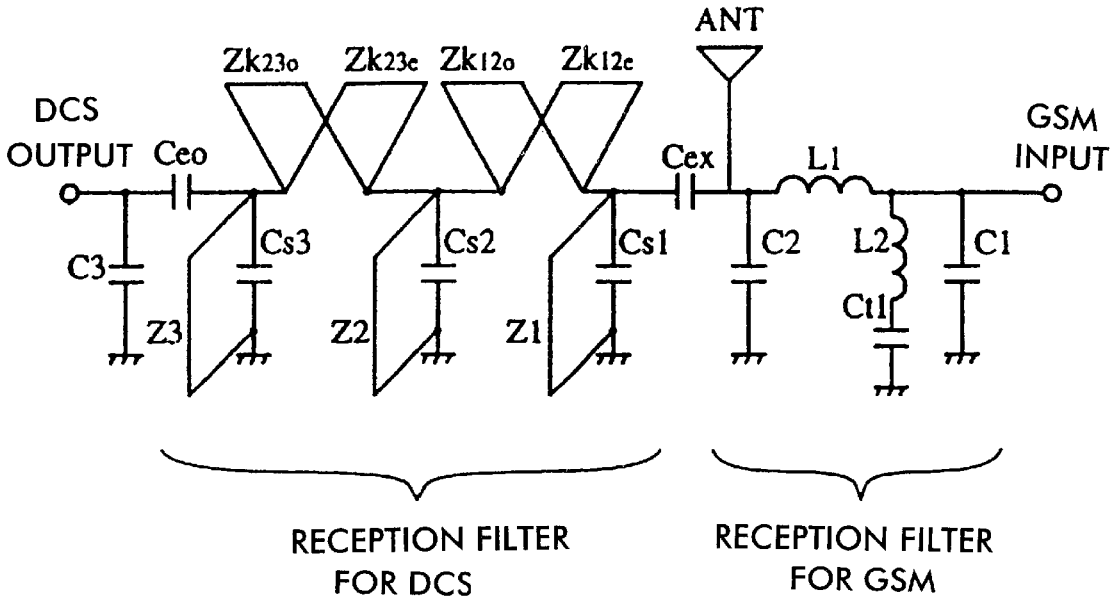
FIG. 7 is an equivalent circuit diagram of the diplexer shown in FIGS. 6A and 6B.

FIG. 7 is an equivalent circuit diagram of the diplexer. The structure of three resonators comprising the three resonance lines and the parts of their comb-line couplings are the same as those shown in FIG. 4. In FIG. 7, reference numeral Ceo indicates the capacitance between the resonance line on the inner surface of the resonance-line hole 2*a* and the terminal electrode 6, and reference numeral C3 indicates the capacitance between the terminal electrode 6 and the ground electrode 3. Reference numeral Cex indicates the capacitance between the resonance line on the inner surface of the resonance-line hole 2*c* and the terminal electrode 7; reference numeral C2 indicates the capacitance between the terminal electrode 7 and the ground electrode 3; and reference numeral C1 indicates the capacitance between the terminal electrode 8 and the ground electrode 3. Reference numeral L1 indicates the inductance generated by the conductor lines 10, 11, and the conductor-line electrode 13. Reference numeral L2 indicates the inductance generated by the conductor line 12, and reference numeral Ct1 indicates the capacitance between the terminal electrode 9 and the ground electrode 3.

In the above structure, the components C1, C2, and L1 form a low pass filter, and the components L2 and Ct1 form a trap. The low pass filter and the trap constitute a reception filter. In addition, the resonance lines disposed in the resonance-line holes 2*a* through 2*c* constitute the other reception filter having pass-band characteristics. For example, the reception filter comprising the low pass filter and the trap is used for the GSM as a mobile-phone system using the 900 MHz band, whereas the reception filter having pass-band characteristics is used for the DCS as a mobile-phone system using the 1.8 GHz band.

Figure 8:
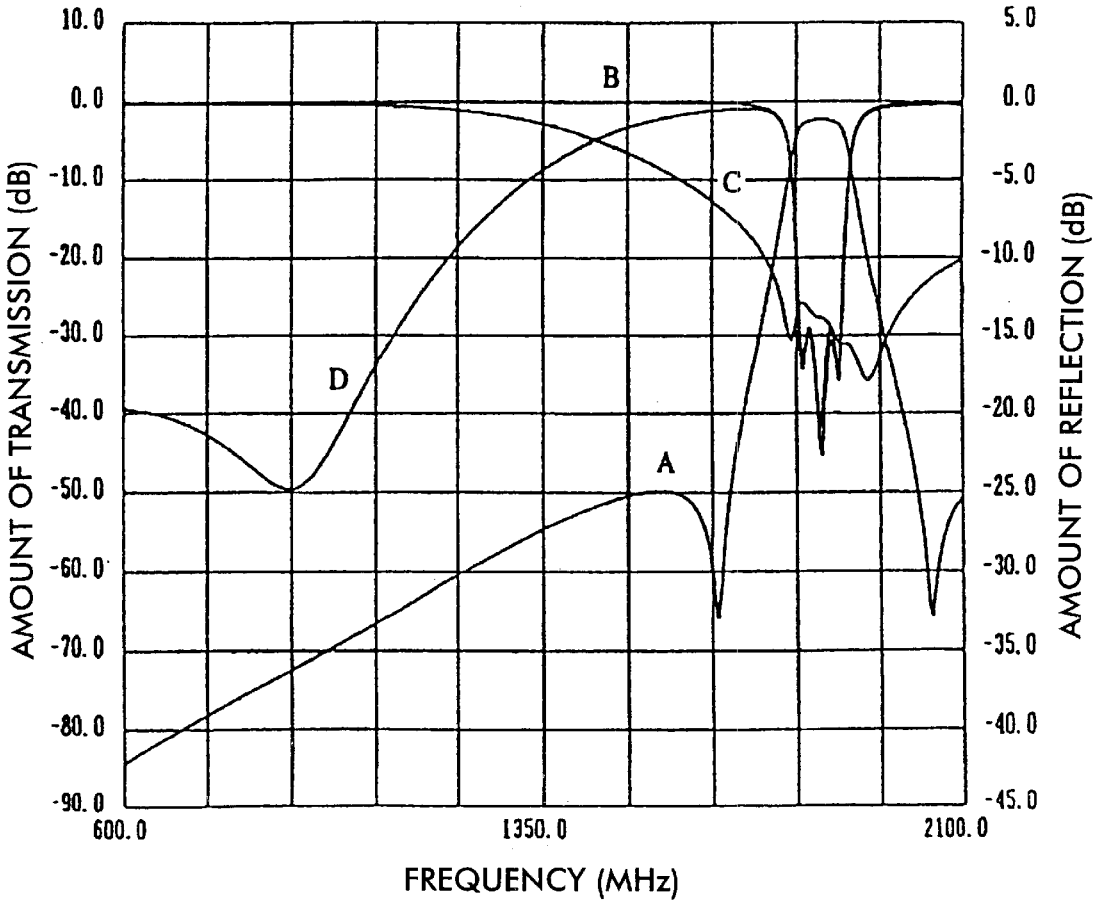
FIG. 8 is a characteristic chart of the diplexer shown in FIGS. 6A and 6B.

FIG. 8 shows the transmission characteristics and reflection characteristics of the two reception filters in a frequency range including the aforementioned two bands. In FIG. 8, the symbol A indicates transmission characteristics of the DCS L1 reception filter, the symbol B indicates the reflection characteristics of the same, whereas the symbol C indicates transmission characteristics of the GSM reception filter, and the symbol D indicates the reflection characteristics of the same. In FIG. 8, the horizontal axis indicates frequency (MHz), and the scales on the left vertical axis indicate amounts of transmission, whereas the scales on the right indicate amounts of reflection. As shown here, the DCS reception filter passes signals of the 1.8 GHz band and blocks signals of the 900 MHz band, whereas the GSM reception filter passes signals of the 900 MHz band and blocks signals of the 1.8 GHz band.

A description will be given of a structure of a duplexer according to a fifth preferred embodiment referring to FIGS. 9 and 10.

Figure 9:
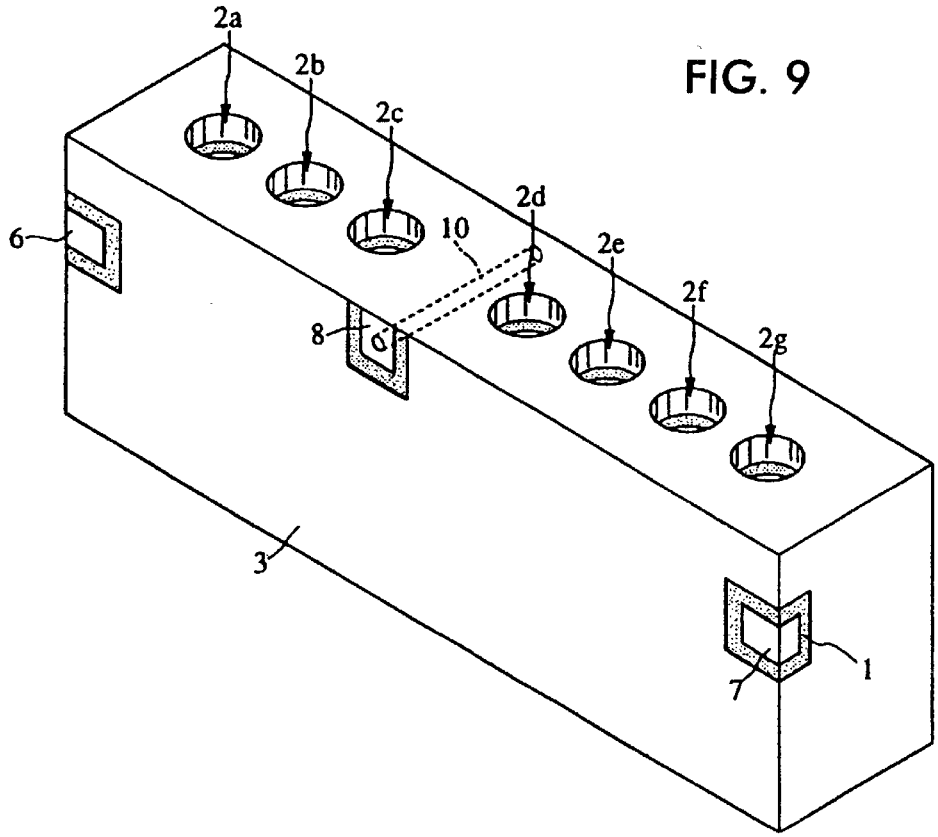
FIG. 9 is a perspective view of a duplexer according to a fifth preferred embodiment of the present invention.

FIG. 9 shows an outward perspective view. The resonance-line holes indicated by 2*a* through 2*g* are disposed in the dielectric block 1, and resonance lines and nonconductive portions are disposed on the inner surfaces of the holes. The structure of three resonators comprising the resonance-line holes 2*a* through 2*c* is the same as that shown in each of the above embodiments, and in this structure, sequential comb-line couplings are made between the adjacent resonators. Capacitive coupling is made between the terminal electrode 6 and the resonance line on the inner surface of the resonance-line hole 2*a*. Meanwhile, the resonance lines disposed on the inner surfaces of the resonance-line holes 2*d* through 2*g* constitute a circuit in which four resonators sequentially make comb-line couplings. Capacitive coupling is made between the terminal electrode 7 and the resonance line on the inner surface of the resonance-line hole 2*g*.

Between the resonance-line holes 2*c* and 2*d*, the conductor line 10 is disposed in a direction perpendicular to the lengthwise direction of the resonance lines. One end of the conductor line 10 is electrically connected to the terminal electrode 8, and the other end of the same is electrically connected to the ground electrode 3.

Figure 10:
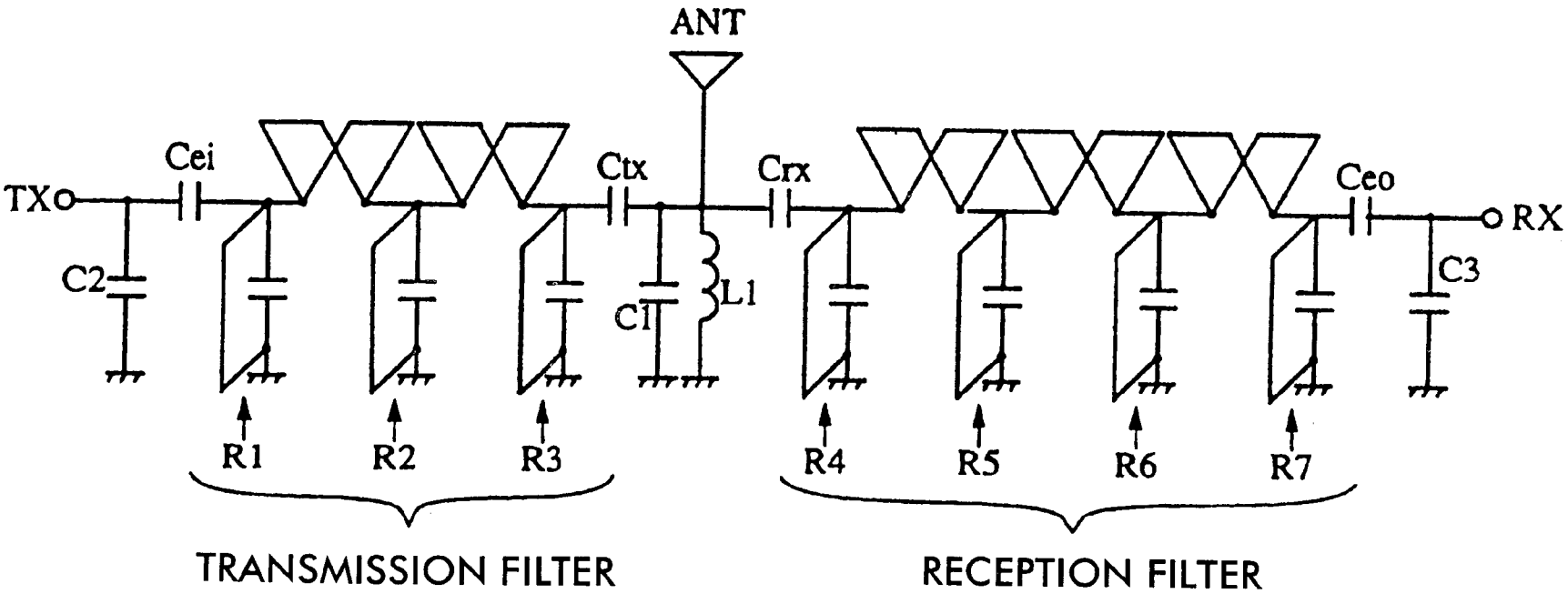
FIG. 10 is an equivalent circuit diagram of the duplexer shown in FIG. 9.

FIG. 10 is an equivalent circuit diagram of the above duplexer. In this case, R1 through R7 are the resonators formed of the resonance-line holes 2*a* through 2*g*. The symbol Cei indicates the coupling capacitance between the terminal electrode 6 and the resonator R1 (the capacitance between the resonance line on the inner surface of the resonance-line hole 2*a* and the terminal electrode 6), and the symbol C2 indicates the capacitance between the terminal electrode 6 and the ground electrode 3. The symbol Ceo indicates the coupling capacitance between the terminal electrode 7 and the resonator R7 (the capacitance between the resonance line on the inner surface of the resonance-line hole 2*g* and the terminal electrode 7), and the symbol C3 indicates the capacitance between the terminal electrode 7 and the ground electrode 3. In addition, the symbol Ctx indicates the coupling capacitance between the resonator R3 and the terminal electrode 8. Similarly, the symbol Crx indicates the coupling capacitance between the resonator R4 and the terminal electrode 8. The symbol L1 indicates the inductance of the conductor line 10, and the symbol C1 indicates the capacitance between the terminal electrode 8 and the ground electrode 3.

This arrangement provides a duplexer including a transmission filter comprising the resonators R1 through R3 and a reception filter comprising the resonators R4 through R7. In this case, the symbol L1 forms a phase-shift circuit. In other words, the impedance in the transmission-frequency band of the reception filter viewed from a branch point and the impedance in the reception-frequency band of the transmission filter viewed from a branch point are set to be close to a state (in which the phase is 0° and the impedance is infinite). This improves matching of phases of the transmission filter and the reception filter.

Figure 11:
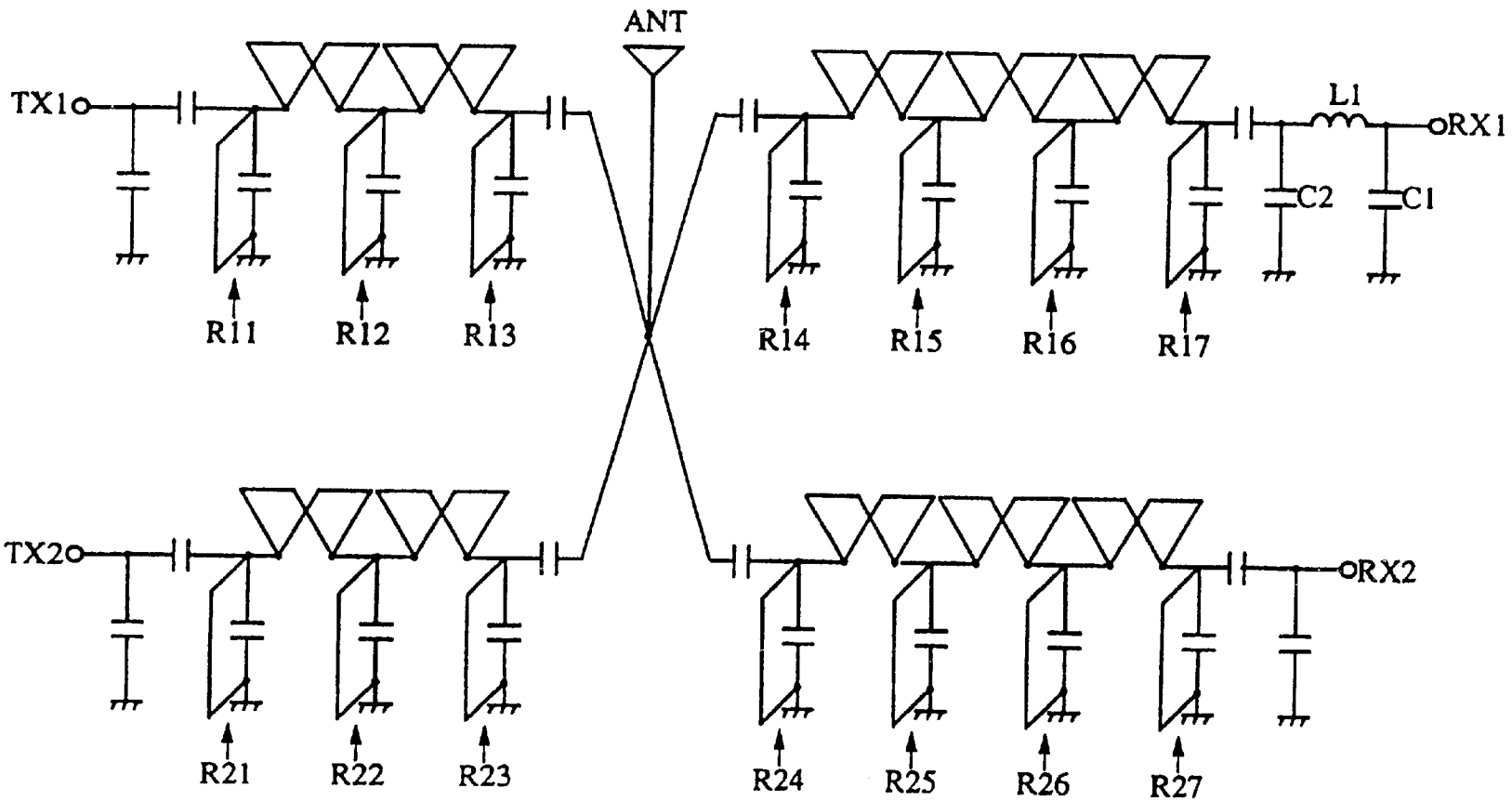
FIG. 11 is an equivalent circuit diagram of multiplexer according to a sixth preferred embodiment of the present invention.

The duplexer shown in FIG. 9 has a single transmission filter and a single reception filter. However, a multiplexer may be formed by disposing a plurality of transmission filters and a plurality of reception filters in a common dielectric block. FIG. 11 shows an equivalent circuit diagram of the multiplexer. In FIG. 11, the circuit section comprising resonators R11 through R13 constitutes a first transmission filter, and the circuit section comprising resonators R14 through R17 constitutes a first reception filter. In addition, the circuit section comprising resonators R21 through R23 constitutes a second transmission filter, and the circuit section comprising resonators R24 through R27 constitutes a second reception filter. The symbol L1 indicates the inductance made by a conductor line disposed in a dielectric block, the symbol C2 indicates the capacitance between an electrode at one end of the conductor line forming L1 and a ground electrode, and the symbol C1 indicates the capacitance between a terminal electrode as an RX1 terminal and a ground electrode. A circuit formed of these components L1, C1, and C2 operates as a low pass filter to block unnecessary signals in the two transmission-frequency bands and other reception-frequency bands.

In the duplexer shown in FIG. 9, the resonance-line holes may be either step holes or straight holes. Additionally, as in the case shown in FIG. 13A, open-end electrodes to be continued from the resonance lines may be disposed on an end face of the dielectric block, which is the open end of each resonance-line hole. In this structure, also, the resonance-line holes may be either step holes or straight holes. When the resonance-line holes may be step holes, as in the case shown in FIG. 13B, one of the end faces of the dielectric block, which is an opening of each resonance-line hole, may be an open face.

Furthermore, the above-described structure may be applied to a structure in which a plurality of transmission filters or a plurality of reception filters are arranged in a common dielectric block, or a structure in which a plurality of transmission filters and a plurality of reception filters are arranged in a common dielectric block so as to form a diplexer or a multiplexer.

Figure 12:
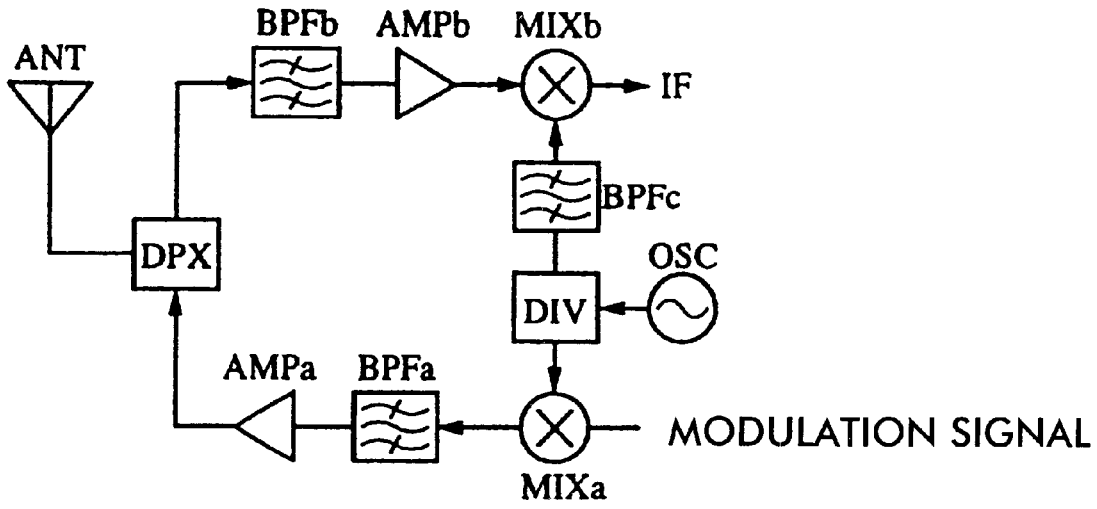
FIG. 12 is a block diagram showing a structure of a communication apparatus according to a seventh preferred embodiment of the present invention.

Referring to FIG. 12, a description will be given of a structure of a communication apparatus using the dielectric filter or the duplexer described above. In this figure, the symbol ANT indicates a transmission/reception antenna, the symbol DXP indicates a duplexer, the symbols BPFa, BPFb, and BPFc indicate band pass filters, the symbols AMPa and AMPb indicate amplification circuits, the symbols MIXa and MIXb indicate mixers, the symbol OSC indicates an oscillator, and the symbol DIV indicates a frequency divider (a synthesizer). The mixer MIXa modulates frequency signals output from the DIV by modulation signals, the band pass filter BPFa passes only signals of the transmission-frequency band, and the amplification circuit AMPa performs power-amplification of the signals to transmit from the antenna ANT through the duplexer DPX. The band pass filter BPFb passes only signals of the reception-frequency band among those signals output from the DPX, and the amplification circuit AMPb amplifies them. The mixer MIXb performs mixing of the frequency signals output from the band pass filter BPFc and the reception signals to output intermediate-frequency signals IF.

As the duplexer DPX shown in FIG. 12, the duplexer of the structure shown in FIGS. 9 through 10 can be used. In addition, the dielectric filter of the structure shown in FIGS. 1 through 5, and FIG. 13, can be used as the band pass filters BPFa, BPFb, and BPFc. This arrangement permits an overall compact communication apparatus to be provided.

Other features and advantages of the present invention will become apparent from the following description of the invention which refers to the accompanying drawings.

What is claimed is:

1. A dielectric filter comprising:

a dielectric block;

a plurality of resonance lines aligned substantially in parallel in the dielectric block; and a plurality of conductor lines disposed in the dielectric block so as not to be parallel to the longitudinal direction of the resonance lines, the conductor lines serving as devices having an inductance component which is connected to a circuit comprising the resonance lines, at least two of the plurality of conductor lines cooperating with at least one capacitance formed on the dielectric block to form a trap filter.

2. The dielectric filter according to claim 1, further comprising:

a ground electrode disposed on a surface of the dielectric block; and an electrode disposed at an end of at least one of the conductor lines and generating a capacitance component between the ground electrode and the electrode.

3. A composite dielectric filter comprising: a plurality of dielectric filters including the dielectric filter of claim 2, which are provided in a common dielectric block.

4. A duplexer comprising a transmission filter and a reception filter formed of the composite dielectric filter according to claim 3.

5. A communication apparatus comprising the dielectric filter according to claim 2 disposed in a high-frequency circuit section.

6. A composite dielectric filter comprising: a plurality of dielectric filters including the dielectric filter of claim 1, which are provided in a common dielectric block.

7. A communication apparatus comprising the composite dielectric filter of claim 6 disposed in a high-frequency circuit section.

8. A duplexer comprising a transmission filter and a reception filter formed of the composite dielectric filter according to claim 6.

9. A communication apparatus comprising the duplexer of claim 8 disposed in a high-frequency circuit section.

10. A communication apparatus comprising the dielectric filter of claim 1 disposed in a high-frequency circuit section.

11. A composite dielectric filter comprising:

a dielectric block;

a first filter section comprising a plurality of resonance lines aligned substantially in parallel in the dielectric block;

a plurality of conductor lines disposed in the dielectric block so as not to be parallel to a direction in which the resonance lines are aligned in the dielectric block;

a ground electrode disposed on a surface of the dielectric block;

an electrode disposed at an end of at least one of the conductor lines and generating a capacitance component between the ground electrode and the electrode; and a second filter section comprising an inductance component of at least one of the conductor lines and the capacitance component, at least two of the plurality of conductors cooperating with at least one capacitance formed on the dielectric block to form a trap filter.

12. A communication apparatus comprising the composite dielectric filter according to claim 11 disposed in a high-frequency circuit section.

13. A composite dielectric filter comprising: a plurality of dielectric filters including the composite dielectric filter of claim 11, which are provided in a common dielectric block.

14. A duplexer comprising a transmission filter and a reception filter formed of the composite dielectric filter according to claim 13.

15. A dielectric filter comprising:

a dielectric block;

a plurality of resonance lines aligned substantially in parallel in the dielectric block; and a plurality of conductor lines disposed in the dielectric block so as not to be parallel to the longitudinal direction of the resonance lines, the conductor lines serving as devices having an inductance component which is connected to a circuit comprising the resonance lines, the plurality of conductor lines including first and second conductor lines which are not parallel to one another, the first and second conductor lines cooperating with at least one capacitance formed on the dielectric block to form a trap filter.

16. A composite dielectric filter comprising:

a dielectric block;

a first filter section comprising a plurality of resonance lines aligned substantially in parallel in the dielectric block;

a plurality of conductor lines disposed in the dielectric block so as not to be parallel to a direction in which the resonance lines are aligned in the dielectric block;

a ground electrode disposed on a surface of the dielectric block;

an electrode disposed at an end of at least one of the conductor lines and generating a capacitance component between the ground electrode and the electrode; and a second filter section comprising an inductance component of at least one of the conductor lines and the capacitance component, the plurality of conductor lines including first and second conductor lines which are not parallel to one another, the first and second conductor lines cooperating with at least one capacitance formed on the dielectric block to form a trap filter.

* * * * *